US005932090A

United States Patent [19]

Marchionna et al.

[11] Patent Number: 5,932,090

[45] **Date of Patent: *Aug. 3, 1999**

[54] PROCESS FOR THE CONVERSION OF HEAVY CRUDE OILS AND DISTILLATION RESIDUES TO DISTILLATES

[75] Inventors: Mario Marchionna, Milan; Alberto DelBianco, Magenta; Nicoletta Panariti, Lecco, all of Italy

[73] Assignee: Snamprogetti S.p.A., San Donato Milanese, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/640,506

[22] Filed: May 1, 1996

[30] Foreign Application Priority Data

May 26, 1995 [IT] Italy ..... MI95A1095

[51] Int. Cl.[6] ..... C10G 45/00

[52] U.S. Cl. ..... 208/212; 208/97; 208/210; 208/218; 208/309; 208/100; 208/95; 208/96

[58] Field of Search ..... 208/96, 95, 97, 208/112, 1, 309

[56] References Cited

U.S. PATENT DOCUMENTS 3,859,199 1/1975 Gatsis ..... 208/97
4,454,023 6/1984 Lutz ..... 208/96
5,382,728 1/1995 Del Bianco et al. ..... 585/24
5,438,039 8/1995 Del Bianco et al. ..... 507/283

*Primary Examiner*—Helane Myers
*Attorney, Agent, or Firm*—Oblon, Spivak, McClelland, Maier & Neustadt, P.C.

[57] ABSTRACT

The process for the conversion of heavy crude oils or distillation residues to distillates comprises the following steps:

mixing the heavy crude oil or distillation residue with a suitable hydrogenation catalyst and sending the mixture obtained to a hydrotreating reactor introducing hydrogen or a mixture of hydrogen and $H_2S$;

sending the stream containing the hydrotreating reaction product and the catalyst in slurry phase to a distillation zone where the most volatile fractions are separated;

sending the high-boiling fraction obtained in the distillation step to a deasphaltation step obtaining two streams, one consisting of deasphalted oil (DAO), the other consisting of asphaltenes, catalyst in slurry phase, possibly coke and rich in metals coming from the initial charge;

recycling at least 60%, preferably at least 80% of the stream consisting of asphaltenes, catalyst in slurry phase, optionally coke and rich in metals, to the hydrotreatment zone.

10 Claims, 2 Drawing Sheets

PROCESS FOR THE CONVERSION OF HEAVY CRUDE OILS AND DISTILLATION RESIDUES TO DISTILLATES

The present invention relates to a process for the conversion of heavy crude oils and distillation residues by the use of hydrogenation catalysts in slurry phase which are recovered and recycled without the necessity of regeneration.

The conversion of heavy crude oils and petroleum residues can be basically carried out in two ways: one exclusively thermal, the other by hydrogenating treatment.

Studies are at present being mainly directed towards hydrogenating treatment, as thermal processes have problems relating to the disposal of the byproducts, especially coke (obtained in quantities even higher than 30% by weight with respect to the charge) and to the poor quality of the conversion products Hydrogenating processes consist in treating the charge in the presence of hydrogen and suitable catalysts.

The hydroconversion technologies presently on the market use fixed-bed or ebullated-bed reactors with catalysts generally consisting of one or more transition metals (Mo, W, Ni, Co, etc.) supported on silica/alumina (or equivalent material).

Fixed-bed technologies have considerable problems in treating particularly heavy charges containing high percentages of heteroatoms, metals and asphaltenes, as these contaminants cause the rapid deactivation of the catalyst.

To treat these charges ebullated-bed technologies have been developed and sold, which have an interesting performance but are extremely complex and costly.

Hydrotreatment technologies operating with catalysts in slurry phase can be an attractive solution to the disadvantages of the fixed-bed or ebullated-bed technologies. Slurry processes, in fact, combine the advantage of a wide flexibility on the charge with high performances in terms of conversions and upgrading, and are also "simple" from a technological point of view.

Slurry technologies are characterized by the presence of catalyst particles whose average dimensions are very small and efficiently dispersed in the medium; for this reason the hydrogenation processes are easier and more immediate in all points of the reactor. The formation of coke is considerably reduced and the upgrading of the charge is high.

The catalyst can be introduced as a powder with sufficiently reduced dimensions (U.S. Pat. No. 4,303,634) or as an oil-soluble precursor (U.S. Pat. No. 5,288,681). In the latter case the active form of the catalyst (generally the metal sulfide) is formed "in situ" by the thermal decomposition of the compound used, during the reaction itself or after suitable pretreatment (U.S. Pat. No. 4,470,295).

The metal constituents of the dispersed catalysts are generally one or more transition metals (preferably Mo, Ni or Co).

The use of dispersed catalysts, although solving most of the problems for the technologies described above, still have disadvantages mainly relating to the life cycle of the catalyst itself.

The procedure for using these catalysts (type of precursors, concentration, etch) is in fact of great importance from the point of view of both cost and environmental impact.

The catalyst can be used at a low concentration (a few hundreds of ppm) in a "once-through" asset but in this case the upgrading of the reaction products is insufficient. Operating with higher concentrations of catalyst (thousands of ppm of metal) it is necessary to recycle the catalyst.

The catalyst leaving the reactor can be recovered by separation from the product obtained from the hydrotreatment (preferably from the bottom of the distillation column downstream of the reactor) with the conventional methods such as decanting, centrifugation or filtration (U.S. Pat. No. 3,240,718; U.S. Pat. No. 4,762,812). Part of the catalyst can be recycled to the hydrogenation process without further treatment. However, the catalyst recovered using the known hydrotreatment processes normally has a reduced activity with respect to the fresh catalyst and a suitable regeneration step is therefore necessary to restore the catalytic activity and recycle at least part of the catalyst to the hydrotreatment reactor.

We have now surprisingly found a new method which enables the recovered catalyst to be recycled to the hydrotreatment reactor without the necessity of a further regeneration steps at the same time obtaining a good-quality product without the production of residue ("zero refinery residue").

The process for converting heavy crude oils or distillation residues to distillates, of the present invention, comprises the following steps:

- mixing the heavy crude oil or distillation residue with a suitable hydrogenation catalyst and sending the mixture obtained to a hydrotreatment reactor introducing hydrogen or a mixture of hydrogen and $H_2S$;
- sending the stream containing the hydrotreatment reaction product and the catalyst in slurry phase to a distillation zone where the most volatile fractions are separated;
- sending the high-boiling fraction obtained in the distillation step to a deasphaltation step obtaining two streams, one consisting of deasphalted oil (DAO), the other consisting of asphaltenes, catalyst in slurry phase, possibly coke and rich in metals coming from the initial charge;
- recycling at least 60%, preferably at least 80% of the stream consisting of asphaltenes, catalyst in slurry phase, optionally coke and rich in metals, to the hydrotreatment zone.

The catalysts used can be selected from those which can be obtained from easily decomposable oil-soluble precursors (metal naphthenates, metal derivatives of phosphonic acids, metal-carbonyls, etc) or preformed compounds based on one or more transition metals such as Ni, Co and Mo: the latter is preferred owing to its high catalytic activity.

Figure 1:
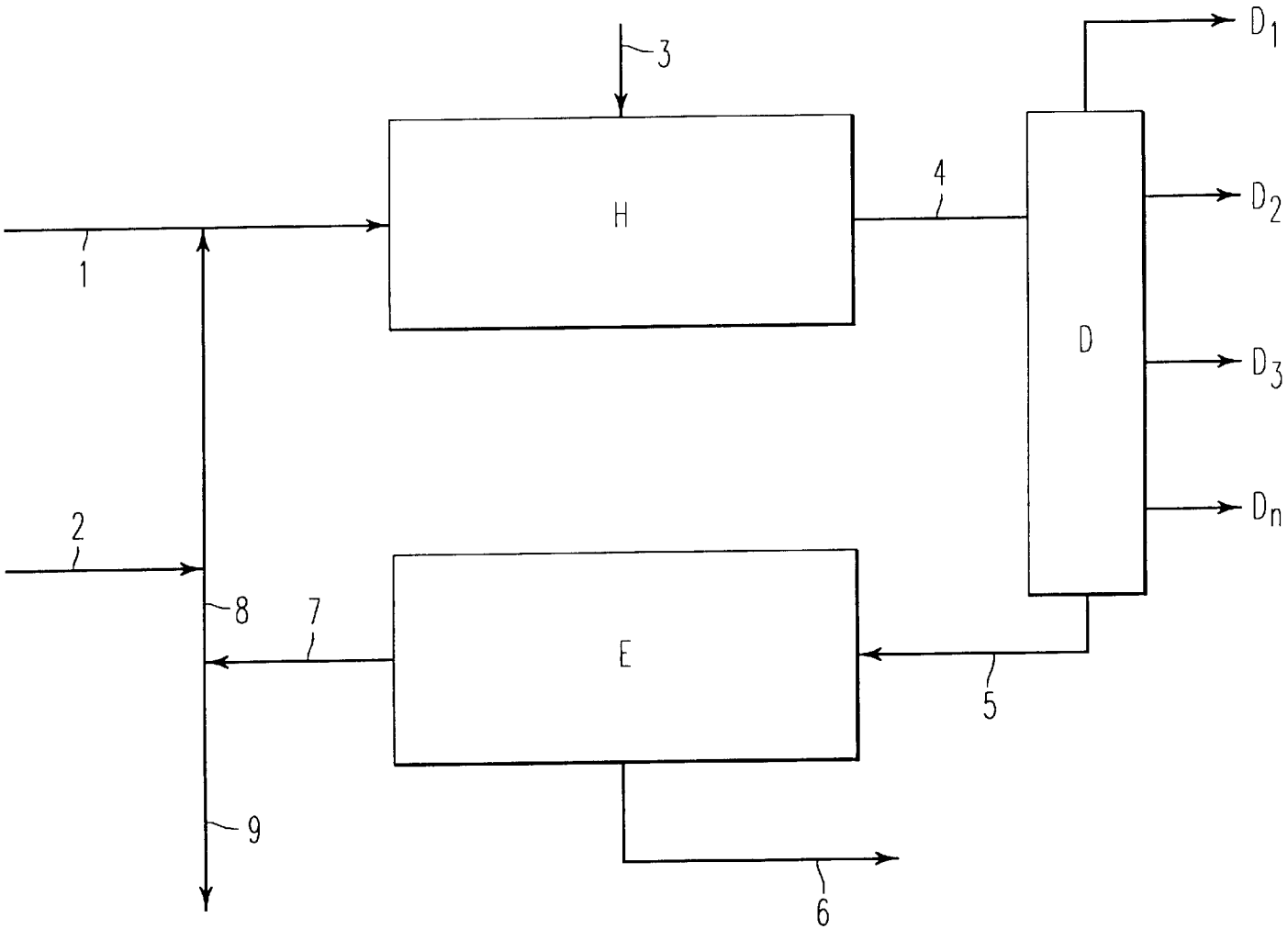
FIG. 1 is a schematic representation of the process for converting heavy crude oil or distillation residues to distillates.

The hydrotreatment step is preferably carried out at a temperature of between 370 and 480° C., more preferably between 380 and 420° C., and at a pressure of between 30 and 300 Atm, more preferably between 100 and 180 Atm.

The deasphaltation step, preferably carried out by an extraction with a solvent (for example with paraffins having from 3 to 6 carbon atoms) is generally carried out at temperatures of between 40 and 200° C. and at a pressure of between 1 and 50 Atm.

The distillation step can be carried out at atmospheric pressure and/or under vacuum with the help of one or more columns.

A preferred embodiment of the present invention is now provided with the help of an enclosed diagram which however does not limit the scope of the invention itself.

The heavy crude oil or distillation residue (1) is mixed with the fresh catalyst (2) and fed to the hydrotreating reactor (H) into which hydrogen (or a mixture of hydrogen/

$H_2$—S) is introduced (3). A stream (4) leaves the reactor, containing the reaction product and the catalyst in slurry phase, which is fractionated in a distillation column (D) from which the lighter fractions ($D_1$, $D_2$, $D_3$, $D_n$) are separated from the distillation residue (5).

This residue (5) is in turn sent to a deasphaltation unit (E), an operation which is carried out by extraction with a solvent. Two streams are obtained from the deasphaltation unit (E): one (6) consisting of deasphalted oil (DAO), the other (7) of asphaltenes, coke and the catalyst in slurry phase.

The stream (7) is recycled either totally or mostly (8) apart from a flushing (9), to the hydrotreatment reactor (H) after being mixed with a suitable quantity of fresh charge (1) and optionally with fresh catalyst (2).

The following example provides a better understanding of the present invention but does not limit it in any way.

EXAMPLE

Following the diagram represented in FIG. 1 the following experiment was carried out:

Hydrotreating step

Reactor: 30 cc, made of steel with capillary stirring

Charge: vacuum residue from Belayim crude oil 10 g with an asphaltene content equal to 21.6% by weight.

Precursor: molibden naphthenate 3000 ppm of Mo/charge

Temperature: 400° C.

Pressure: 170 Atm of hydrogen

Residence time: 4 h

Deasphaltation step

Deasphalting agent: n-pentane 400 cc

Temperature: room temperature

Pressure: atmospheric

Streams at outlet after 3 recycles:

Deasphalted oil (DAO): 50% by weight with respect to charge

Stream (7) consisting of:

| |
|---|
| Asphaltenes: 22% by weight with respect to charge |
| Coke: 5% by weight with respect to charge |
| Dispersed catalyst: 100% of that entering the reactor |

Recycles:

100% of the stream (7) is mixed with such a quantity of vacuum residue so as to always obtain the same initial quantity of charge (10 g).

The gases and light fractions are separated before deasphaltation with the conventional laboratory methods.

On comparing some of the characterization data of the DAO (% S, ppm of Ni, V) recovered after 3 recycles with that recovered after 1 recycle it can be observed that the quality of this does not significantly degenerate and therefore there do not seem to be particular deactivation problems of the catalyst (see table I).

Figure 2:
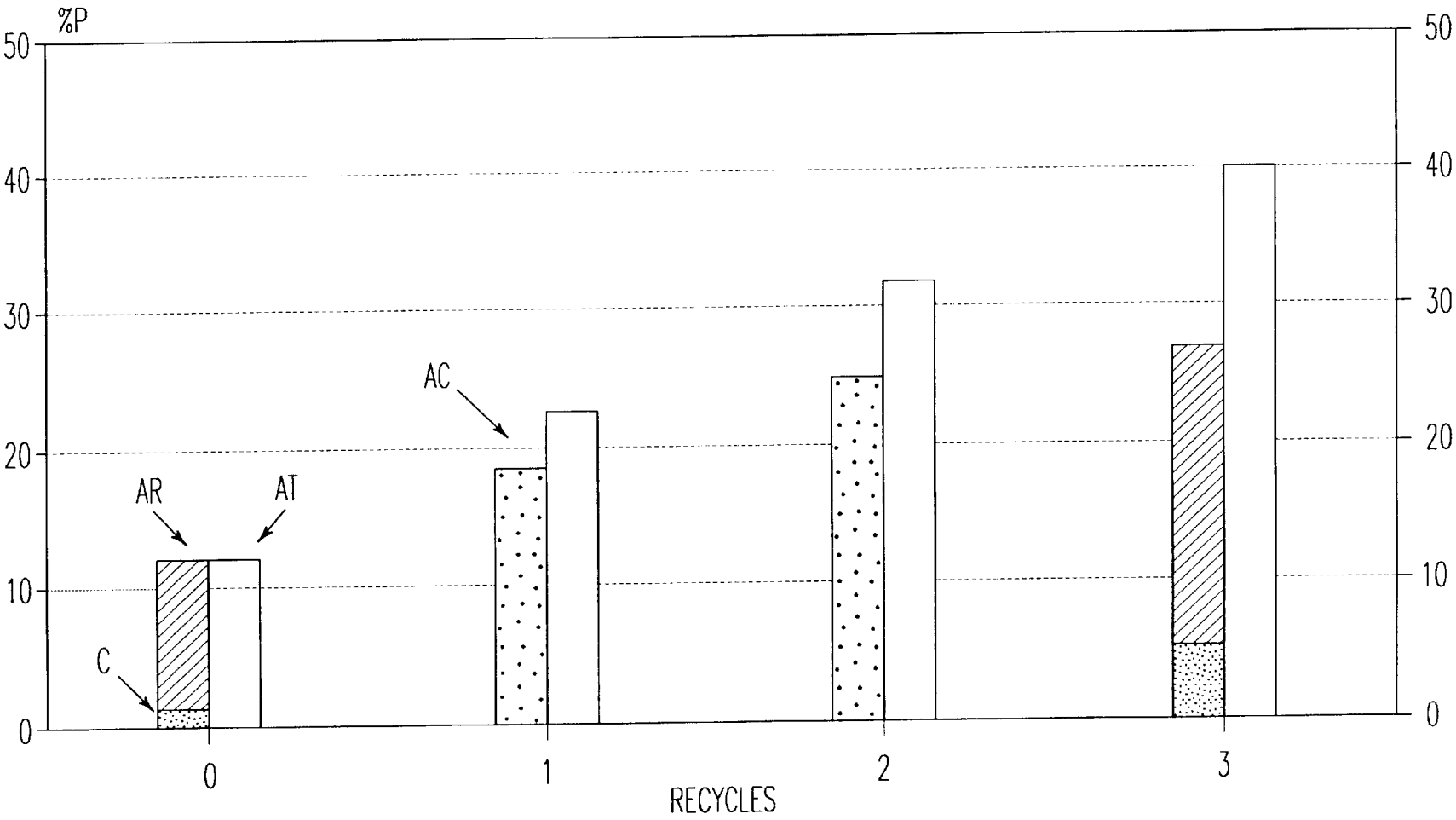
FIG. 2 shows the results relating to the reactivity of the asphaltines.

FIG. 2 shows the results relating to the reactivity of the asphaltenes by means of a bar graph having the number of recycles in abscissa and the percentage of $C_5$ asphaltenes in the ordinate (wherein c=coke; ar=asphaltenes recovered; at=theoretic accumulation of asphaltenes; ac=asphaltenes+coke).

The data relating to the theoretic accumulation of asphaltenes were calculated by assuming a conversion of about 50% for "fresh" asphaltenes (as occurs during the first test with fresh charge) and zero for those recycled.

On comparing these data with those obtained experimentally it can be noted that also the recycled asphaltene component is further converted in the subsequent treatment.

The same figure also indicates the percentages of coke which is produced during step (I) and which is recycled together with the asphaltenes.

TABLE I

| | % S | ppm Ni/V | % CCR |
|---|---|---|---|
| DAO (after 1 recycle) | 2.2 | <5 | 7.4 |
| DAO (after 2 recycles) | 2.2 | <5 | 7.3 |
| DAO (after 3 recycles) | 2.4 | <5 | 6.6 |

We claim:

1. Process for the conversion of heavy crude oils and distillation residues to distillates comprising the following steps:

admixing said heavy crude oil or distillation residue with a suitable hydrogenation catalyst to obtain a mixture, transferring said mixture to a hydrotreating reactor and introducing hydrogen or a mixture of hydrogen and $H_2S$ to said hydrotreating reactor and hydrotreating said heavy crude oils at a temperature of between 370 and 480° C., thus converting said heavy crude oils and distillation residues to distillates;

transferring a stream containing the hydrotreated reaction product and the catalyst to a distillation zone and distilling a stream containing the hydrotreated reaction product and the catalyst in the slurry phase and separating the most volatile fractions;

deasphalting a high-boiling fraction obtained in the distillation step by transferring said high-boiling fraction to a deasphaltation zone obtaining two streams, one consisting of deasphalted oil (DAO), the other comprising asphaltenes, catalyst in slurry phase, coke and rich in metals coming from the initial charge;

recycling at least 60% of said stream comprising asphaltenes, catalyst in slurry phase, coke, and rich in metals, to the hydrotreating zone;

wherein said hydrogenation catalyst is in slurry phase.

2. Process according to claim 1 wherein at least 80% of the stream comprising asphaltenes, catalyst in slurry phase and coke is recycled to the hydrotreating zone.

3. Process according to claim 1 or 2 wherein the hydrotreating step is carried out at a temperature of between 370 and 480° C. and at a pressure of between 30 and 300 Atm.

4. Process according to claim 3 wherein the hydrotreating step is carried out at a temperature of between 380 and 420° C. and at a pressure of between 100 and 180 Atm.

5. Process according to claim 1 or 2 wherein the deasphaltation step is carried out at a temperature of between 40 and 200° C. and at a pressure of between 1 and 50 Atm.

6. Process according to claim 1 or 2 wherein the deasphaltation step is carried out by extraction with a solvent.

7. Process according to claim 6 wherein the solvent is light paraffin with from 3 to 6 carbon atoms.

8. Process according to at least one of the previous claims wherein the hydrogenation catalyst is an easily decomposable precursor or a preformed compound based on one or more transition metals.

9. Process according to claim 8 wherein the transition metal is molybdenum.

10. The process of claim 1, wherein said hydrotreating step is carried out at a temperature of from about 370° C. to 380° C.; and wherein said stream is substantially free of coke.

* * * * *